US005284686A

United States Patent [19]

Thow

[11] Patent Number: 5,284,686

[45] **Date of Patent: * Feb. 8, 1994**

[54] COMPOSITE ARTIFICIAL LOG

[75] Inventor: Ian Thow, St. Helens, England

[73] Assignee: Yale and Valor p.l.c., Birmingham, England

[ * ] Notice: The portion of the term of this patent subsequent to Jun. 25, 2008 has been disclaimed.

[21] Appl. No.: 661,868

[22] Filed: Feb. 27, 1991

Related U.S. Application Data

[63] Continuation-in-part of Ser. No. 443,109, Nov. 28, 1989, Pat. No. 5,026,579.

[51] Int. Cl.[5] ..... F24C 3/04

[52] U.S. Cl. ..... 428/15; 126/92 AC; 126/512; 428/18; 431/125

[58] Field of Search ..... 126/92 AC, 92 R, 512; 428/15, 18; 431/125

[56] References Cited

U.S. PATENT DOCUMENTS

| | | | |
|---|---|---|---|
| 3,231,401 | 1/1966 | Price et al. | 501/105 |
| 3,253,936 | 5/1966 | Weindel et al. | 501/124 |
| 3,362,395 | 1/1968 | Peterson | 126/92 R |
| 3,377,229 | 4/1968 | Bryan | 428/18 |
| 3,871,355 | 3/1975 | Henry | 431/125 X |
| 3,947,229 | 3/1976 | Richter | 431/125 |
| 4,076,490 | 2/1978 | Hilker | 431/125 |
| 4,573,905 | 3/1986 | Meyers | 431/125 |
| 4,637,372 | 1/1987 | Mogol et al. | 431/125 X |
| 4,664,620 | 5/1987 | Kendall et al. | 431/328 |
| 4,838,240 | 6/1989 | Rieger | 428/18 X |
| 4,883,043 | 11/1989 | Thow et al. | 428/18 X |
| 4,962,750 | 10/1990 | Bridgewater | 428/15 X |
| 4,971,030 | 11/1990 | Thow et al. | 431/125 X |
| 5,026,579 | 6/1991 | Thow | 428/15 |
| 5,069,200 | 12/1991 | Thow et al. | 126/512 |

*Primary Examiner*—Henry F. Epstein
*Attorney, Agent, or Firm*—Wood, Herron & Evans

[57] ABSTRACT

The present invention is directed to a composite artificial log for use in gas-fired artificial log fireplace assemblies or stoves, and more particularly, to a composite artificial log which has a ceramic concrete section molded to resemble a real log and having a relatively high thermal conductivity, which radiates a substantial amount of heat to the surroundings when heated, and one or more ceramic fiber sections having a relatively low thermal conductivity, which glow visibly when heated above about 1470° F.

9 Claims, 3 Drawing Sheets

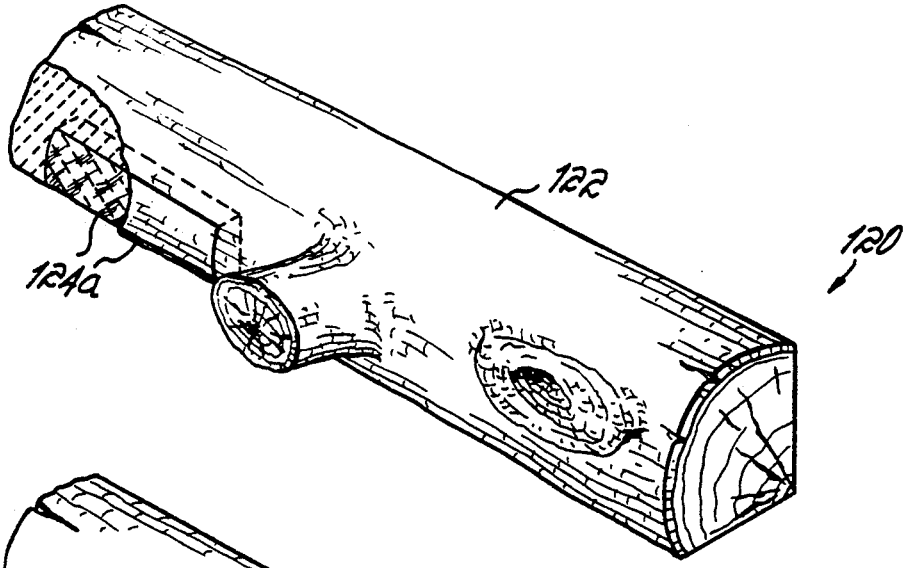
FIG. 6
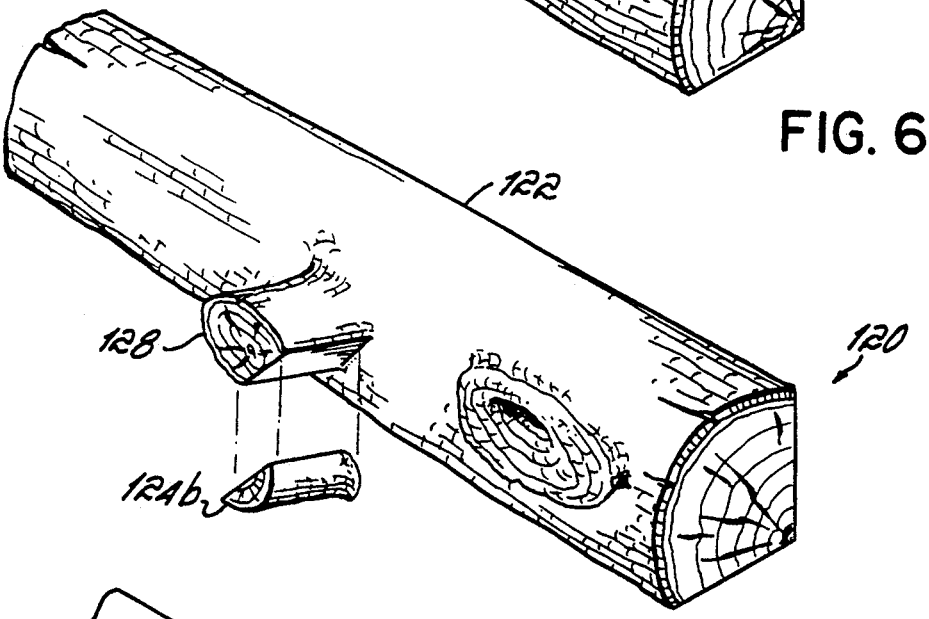
FIG. 7
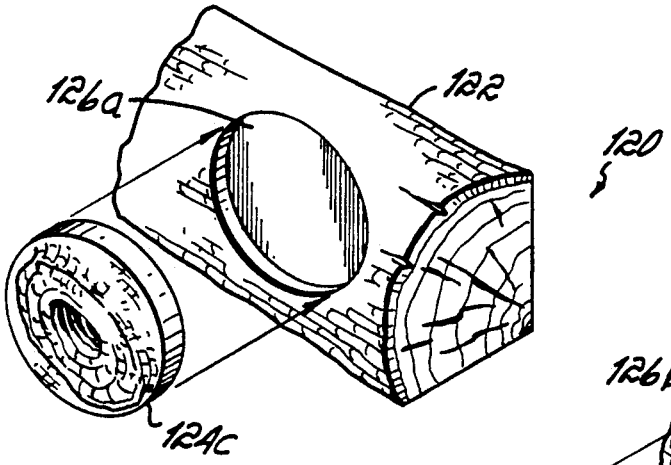
FIG. 8
FIG. 9
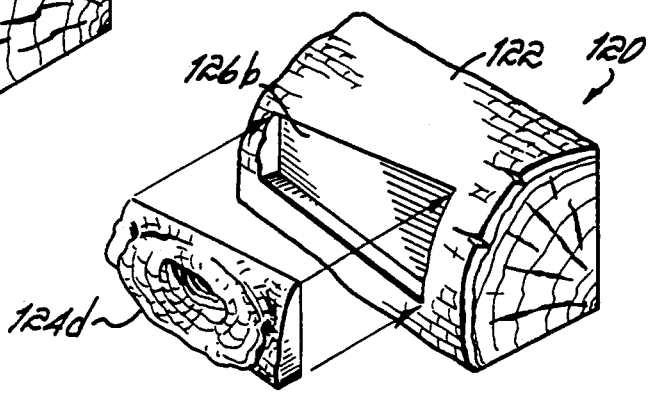

COMPOSITE ARTIFICIAL LOG

This application is a continuation-in-part of application Ser. No. 07/443,109, filed Nov. 28, 1989, now U.S. Pat. No. 5,026,579, issued Jun. 25, 1991.

FIELD OF THE INVENTION

The present invention is directed to a composite artificial log for use in gas-fired artificial log fireplace assemblies or stoves, and more particularly, to a composite artificial log which has a ceramic concrete section molded to resemble a real log and which radiates a substantial amount of heat to the surroundings when heated, and one or more ceramic fiber sections which glow visibly when heated above about 1470° F. (800° C).

BACKGROUND

Fireplaces are very popular and desirable in houses and apartments, both for heating as well as for aesthetics. It is becoming more and more common to install gas-burning fireplaces as an alternative to solid fuel burning fireplaces, however, since the latter require manual refueling and clearing of ashes. Oftentimes, artificial logs are used in gas fireplaces and stoves to add an element of realism to the gas fire.

Known artificial logs are typically made of a refractory material which is impervious to very hot gas flames. U.S. Pat. No. 3,362,395 discloses a variety of refractory materials commonly used for artificial logs. These materials can be molded or manually shaped and decorated to resemble a natural log. While logs of this type may provide a visual resemblance to natural logs, they do not provide the visual effect of a burning log when used in a gas fireplace or stove assembly. What is needed is an artificial log which provides the visual appearance of a natural log, which radiates substantial heat to the surroundings when heated and which glows to provide the appearance of the burning embers of a natural log when heated in a gas fireplace or stove assembly.

SUMMARY OF THE INVENTION

In one preferred embodiment, the present invention is directed to a composite artificial log which has an upper section composed of ceramic concrete, which has a relatively high thermal conductivity and radiates substantial heat to the surroundings when heated, and a lower section composed of inorganic ceramic fiber material having a relatively low thermal conductivity which glows visibly when heated above about 1470° F. (800° C.). Both the upper and lower sections constitute a substantial fraction of the cross-section of the composite log.

In another preferred embodiment, the composite artificial log has a ceramic concrete section for radiating heat to the surroundings when heated and one or more ceramic fiber sections which glow visibly when heated above about 1470° F. (800° C.). The ceramic fiber sections may be in the form of inserts which are either molded into the ceramic concrete section, fitted into cavities provided in the ceramic concrete section, or otherwise attached to the ceramic concrete section. These sections may resemble bark, knots in the log, or truncated branch sections, or they may simply comprise surface sections of the log which are desired to glow when heated. In any case, the ceramic fiber section(s) have at least one surface outwardly exposed in the gas-fired fireplace and stove assemblies in which they are used so as to provide the glowing appearance of a burning natural log.

In all embodiments, the ceramic concrete section of the composite log is preferably made of a material such as crushed firebrick, fire clay grog, or some other refractory material having a relatively high thermal conductivity, above about 0.5 BTU/hr Ft° F. This section of the log can be molded or manually decorated to resemble a natural log and can withstand extremely high temperatures—on the order of 2300° F. Due to its relatively high thermal conductivity, this section radiates a substantial amount of heat to the surroundings when heated. The ceramic fiber section(s) of the log, which are preferably made of a ceramic fiber of inorganic alumina silicate mixed with a suitable amorphous silica binder, have a relatively low thermal conductivity, about 0.09 BTU/hr Ft° F., and glow visibly when heated above about 1470° F. Both the ceramic concrete and ceramic fiber sections have at least one surface outwardly exposed in the gas fireplace or stove assemblies in which they are used. The combined effect of these sections of the composite log of the present invention is such that when the log is heated above about 1470° F., the ceramic concrete section provides the aesthetics of a natural log and radiates substantial heat to the surroundings, while the ceramic fiber section(s) glow visibly, thereby providing an exceptionally realistic-looking artificial log fire.

The ceramic concrete and ceramic fiber sections of the composite log may be secured together in one of several preferred manners. In one embodiment, these sections are secured together with any one of the generally known adhesives that are capable of withstanding the high temperatures. In another embodiment, mechanical fasteners are used to secure the two sections together. In a further embodiment, these sections mate together with at least a portion of the ceramic fiber section mating within a cavity in the ceramic concrete section, to thereby secure the two sections together. In still another embodiment, the ceramic fiber inserts may be cast in place in the ceramic concrete section during molding of the ceramic concrete section.

These and other features and advantages of the present invention will become more apparent with reference to the accompanying drawings and the detailed description thereof.

BRIEF DESCRIPTION OF THE DRAWINGS

FIG. 6 is a perspective view, partially broken away, of an alternative embodiment of the composite log of the present invention.

FIG. 7 is an exploded perspective view of another alternative embodiment of the present invention.

FIG. 8 is an exploded perspective view, partially broken away, of another alternative embodiment of the present invention.

FIG. 9 is an exploded perspective view, partially broken away, of another alternative embodiment of the present invention.

DETAILED DESCRIPTION OF THE INVENTION

Figure 1:
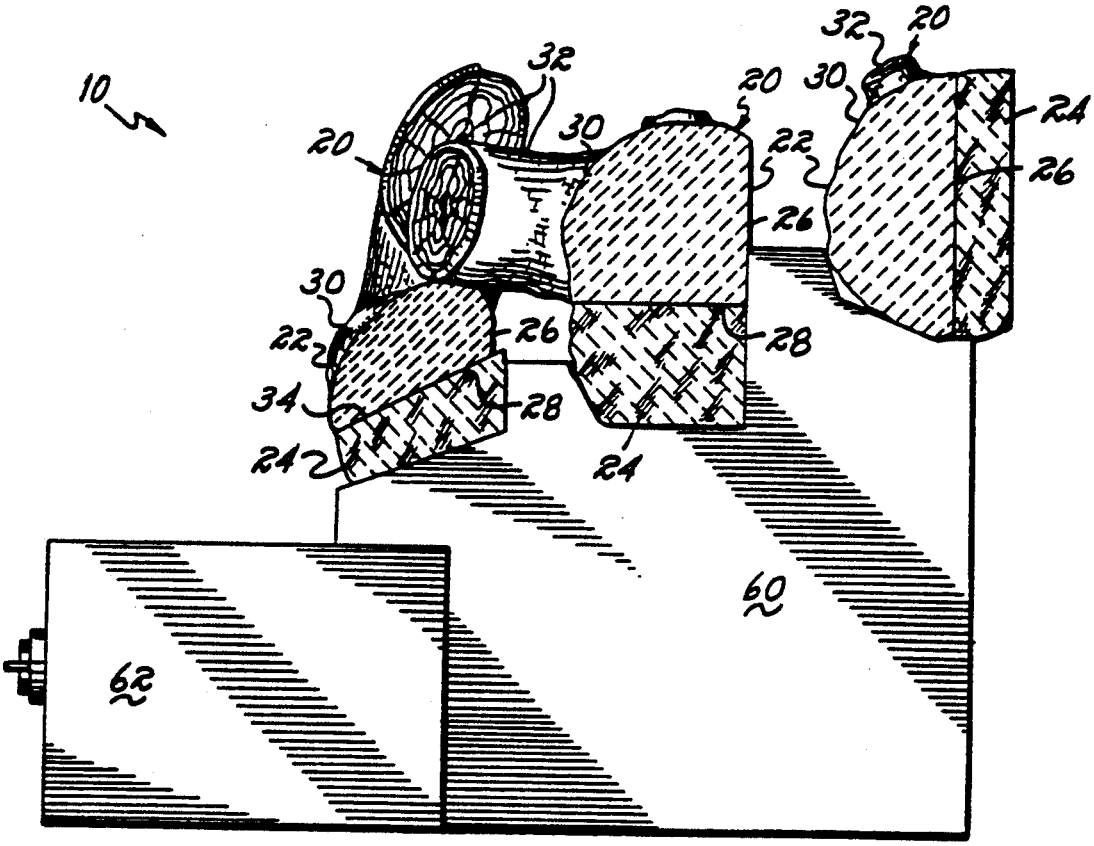
FIG. 1 is a side elevation, in partial cross-section, of an artificial log assembly, including three composite artificial logs of the present invention.

FIG. 1 shows an artificial log assembly 10 for use in a gas-fired fireplace or stove. Assembly 10 includes composite artificial logs 20 of one embodiment of the present invention, a support structure 60 for composite logs 20 and a gas control mechanism 62.

Figure 2:
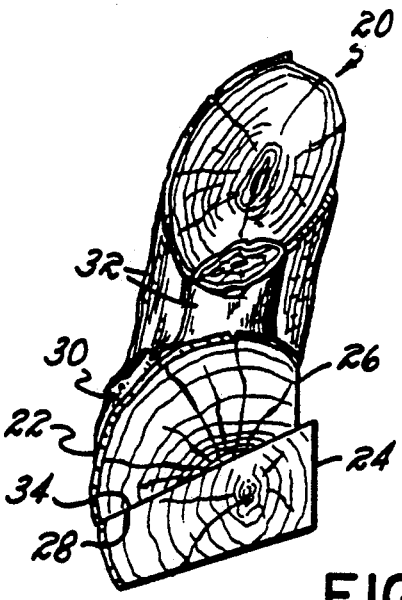
FIG. 2 is an end view of a composite log of the present invention.

FIG. 2 shows an end view of composite log 20, which has an upper section 22 and a lower section 24. In one preferred embodiment, upper section 22 of composite log 20 has substantially flat rear and bottom surfaces 26 and 28, respectively, and a convex front surface 30. In addition, upper section 22 may also include truncated limb segments 32 extending outwardly from front surface 30. Lower section 24 has at least a flat upper surface 34 that corresponds to flat bottom surface 28 of upper section 22. Upper section 22 and lower section 24 are secured together with their bottom and upper surfaces 28 and 34, respectively, in abutting relationship to form one embodiment of the composite log of the present invention.

Upper section 22 of composite log 20 is preferably molded or manually shaped of a ceramic concrete refractory material having the following composition: 15-25% high temperature cement, e.g., that sold by Fondu LaFarge under the trade name SECA R51, with the balance being volcanic aggregate. The material has a thermal conductivity above about 0.5, with the thermal conductivity of the preferred material being 0.5373 BTU/hr Ft° F., and therefore radiates a substantial amount of heat to the surrounding atmosphere when heated. Additionally, this material is easily molded or shaped to resemble a natural wood log with bark, knots and truncated limb segments, as desired.

Lower section 24 of composite log 20 is molded of a material having a thermal conductivity which is relatively low, preferably inorganic alumina silicate fibers in an amorphous silica binder material, which preferably has a thermal conductivity of 0.092 BTU/hr Ft° F. Although it should be appreciated that other ceramic fiber materials may be suitable. This lower section 24 glows visibly when heated above about 1470° F. Thus, when composite log 20 is heated above about 1470° F. by a gas flame, upper section 22 radiates substantial heat to the surroundings while lower section 24 glows visibly, thereby providing the visual effect of a burning log with glowing embers. Both the upper and lower sections, 22 and 24, constitute a substantial fraction of the cross-section of composite log 20.

Upper and lower sections 22 and 24 of composite log 20 are preferably secured together with an adhesive that can withstand the high temperature to which composite log 20 will be exposed. Suitable adhesives are generally known to persons of ordinary skill in the art and the particular adhesive is not a critical aspect of the present invention. In an alternative embodiment, not shown, the upper and lower sections of composite log 20 are secured together with a suitable mechanical fastening or securing means.

Figure 3:
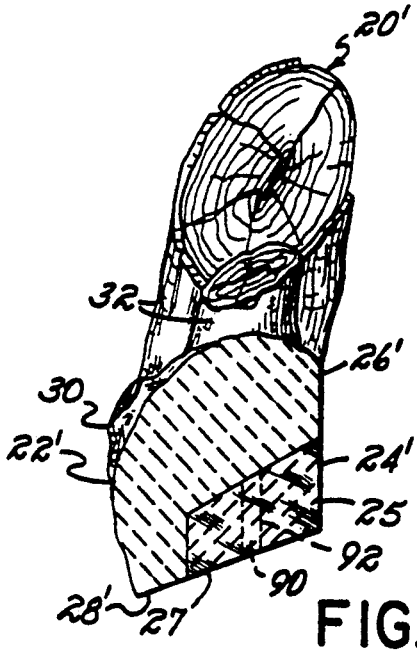
FIG. 3 is a cross-section of an alternative embodiment of the composite artificial log of the present invention.
Figure 4:
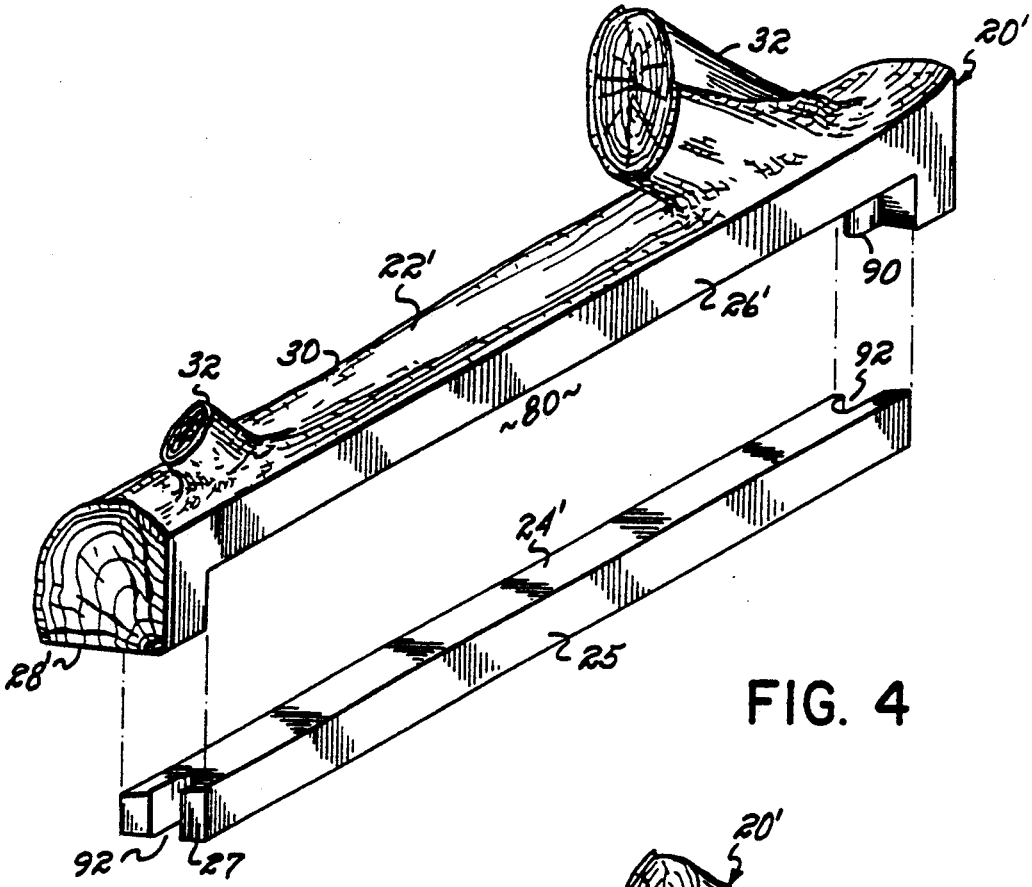
FIG. 4 is an exploded perspective view of the composite log shown in FIG. 3.
Figure 5:
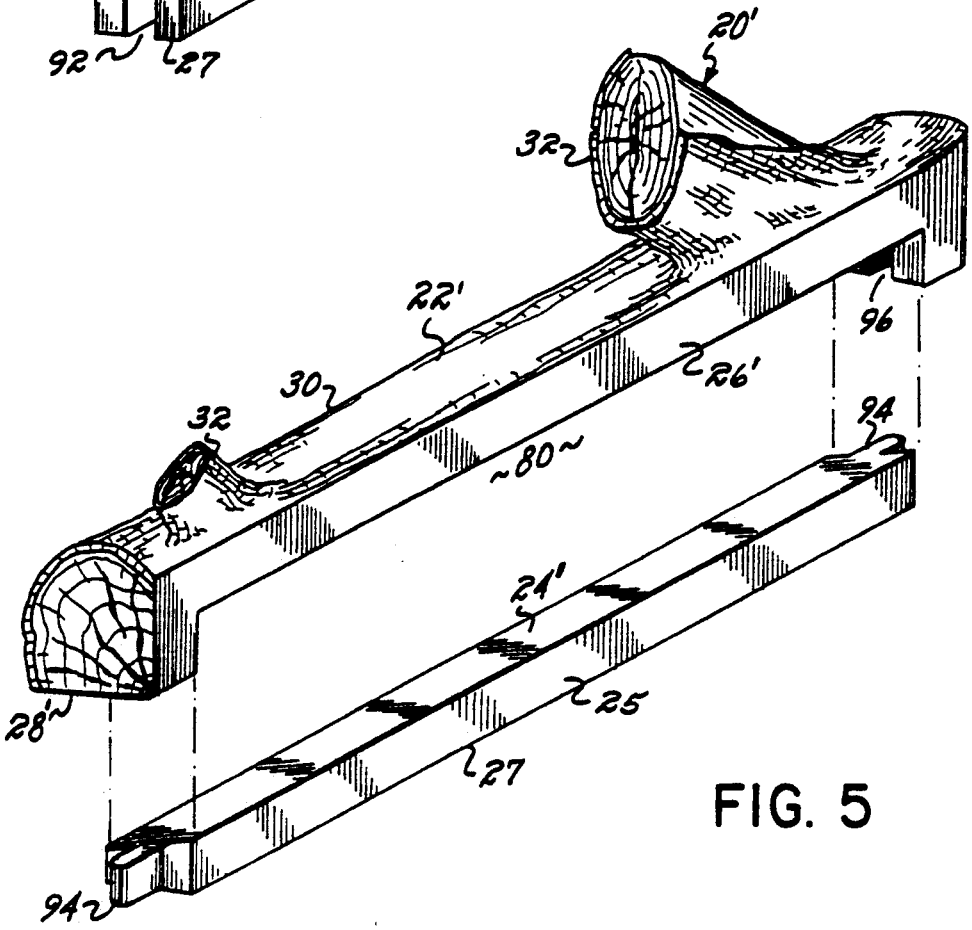
FIG. 5 is an exploded perspective view of an alternative embodiment of the composite log shown in FIG. 3.

FIGS. 3, 4 and 5 show an alternative embodiment of the composite log of the present invention. In this embodiment, composite log 20' has an upper section 22' and a lower section 24', each of which is preferably made of the material disclosed herein with respect to upper and lower sections 22 and 24 of composite log 20, respectively. Upper section 22' has substantially flat rear and bottom surfaces 26' and 28', respectively. In addition, upper section 22' has a cavity 80 therein which confronts rear and bottom surfaces 26' and 28'. Cavity 80 is sized to receive matingly therein (as shown in FIG. 3) lower section 24', while leaving rear and bottom surface portions 25 and 27 of lower section 24' visible when lower section 24' is positioned in cavity 80. Upper section 22' may preferably include projections 90, which project into cavity 80 at opposite ends thereof, and which are adapted to mate with channels 92 in lower section 24' to releasably secure lower section 24' in cavity 80 (FIG. 4). Alternatively, lower section 24' may have projections 94 at opposite ends thereof which are adapted to mate with channels 96 at opposite ends of cavity 80 to releasably secure lower section 24' in cavity 80 (FIG. 5).

FIGS. 6-9 show additional alternative embodiments of the composite log of the present invention. In the embodiments shown, composite log 120 includes a ceramic concrete section 122 and a ceramic fiber section 124*a*, 124*b*, 124*c* and 124*d*, respectively, as shown in FIGS. 6-9. The ceramic fiber sections may be inserts which fit into cavities, e.g., cavities 126*a* and 126*b* in FIGS. 8 and 9, in ceramic concrete section 122. These inserts may be designed to resemble bark on the log or knots in the log. Alternatively, ceramic fiber sections may form all or part (see FIG. 7) of a truncated branch 128 of the log 120.

The ceramic fiber sections, whether they are "inserts" or branch sections, are for the intended purpose of glowing when heated above about 1470° F. to provide the composite log with enhanced visual aesthetics of a burning log. Thus, it should be appreciated that such inserts or other sections may be located in any desired location on composite log 120, so long as the ceramic fiber sections 124*a-d* have at least one surface outwardly exposed in the gas-fired fireplace and stove assemblies in which they are used. The ceramic fiber inserts or other sections are preferably located in areas where there is direct flame impingement on the logs, but this is not a requirement.

The ceramic fiber sections, regardless of their form or location on composite log 120, can be adhered in place with a suitable adhesive, or they can be cast in place by molding the ceramic concrete section around the ceramic fiber section(s).

It will be appreciated by persons skilled in the art that numerous variations on the composite log of the present invention are possible without departing from the spirit of the invention, the scope of which is defined by the appended claims.

I claim:

1. A composite artificial log for use in gas-fired fireplace and stove assemblies comprising:

a ceramic concrete section having an exposed outer surface, said section molded to provide the appearance of a real log, and said section having a relatively high thermal conductivity for radiating heat to the surroundings when heated; and at least one ceramic fiber section having at least one exposed outer surface, said ceramic fiber section secured to said ceramic concrete section and having a relatively low thermal conductivity such that said exposed outer surface thereof glows visibly when heated above about 1470° F.

2. The composite artificial log of claim 1 wherein said ceramic concrete section and said at least one ceramic fiber section are secured together with an adhesive.

3. The composite artificial log of claim 1 wherein said ceramic concrete section and said at least one ceramic fiber section are secured together by molding said ceramic concrete section partially around said ceramic fiber section.

4. The composite artificial log of claim 1 wherein said ceramic fiber section has a surface contiguous with said ceramic concrete section and is configured to provide the appearance of a real log.

5. A composite artificial log for use in gas-fired fireplace and stove assemblies comprising:

a solid elongated ceramic concrete section having an exposed outer surface, said section molded to provide the appearance of a real log, and said section having a relatively high thermal conductivity for radiating substantial heat to the surroundings when heated; and at least one solid section having at least one exposed outer surface, said at least one section secured to said ceramic concrete section and said at least one section consisting essentially of inorganic alumina silicate fibers and a binder material, said at least one section having a relatively low thermal conductivity such that said exposed outer surface thereof glows visibly when heated above about 1470° F.

6. The composite artificial log of claim 5 wherein said binder material is amorphous silica.

7. A composite artificial log for use in gas-fired fireplaces and stove assemblies comprising:

a solid elongated ceramic concrete section having an exposed outer surface, said section molded to provide the appearance of a real log, and said section having a thermal conductivity above about 0.5 BTU/hr Ft° F. for radiating heat to the surroundings when heated; and at least one solid ceramic fiber section having at least one exposed outer surface, said at least one ceramic fiber section secured to said ceramic concrete section, and said at least one ceramic fiber section having a thermal conductivity of approximately 0.09 BTU/hr Ft° F. such that said exposed outer surface thereof glows visibly when heated above about 1470° F.

8. The composite artificial log of claim 7 wherein said ceramic fiber section has a surface contiguous with said ceramic concrete section and is configured to provide the appearance of a real log.

9. A composite artificial log for use in gas-fired fireplaces and stove assemblies comprising:

a first section having an exposed outer surface, said section molded to provide the appearance of a real log, said section having a relatively high thermal conductivity for radiating heat to the surroundings when heated; and a second section having at least one exposed outer surface, said second section secured to said first section and having a relatively low thermal conductivity such that said exposed outer surface thereof glows visibly when heated above about 1470° C.

* * * * *